US008035659B2

(12) United States Patent
Choe et al.

(10) Patent No.: US 8,035,659 B2
(45) Date of Patent: Oct. 11, 2011

(54) APPARATUS AND METHOD FOR REDUCING COLOR ERROR IN DISPLAY HAVING SUB-PIXEL STRUCTURE

(75) Inventors: Won-hee Choe, Gyeongju-si (KR); Seong-deok Lee, Suwon-si (KR); Chang-yeong Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1325 days.

(21) Appl. No.: 11/293,237

(22) Filed: Dec. 5, 2005

(65) Prior Publication Data

US 2006/0132509 A1 Jun. 22, 2006

(30) Foreign Application Priority Data

Dec. 16, 2004 (KR) ..... 10-2004-0106749

(51) Int. Cl.
*G09G 5/10* (2006.01)

(52) U.S. Cl. ..... 345/690

(58) Field of Classification Search ..... 345/690–699
See application file for complete search history.

(56) References Cited

U.S. PATENT DOCUMENTS

| | | | | |
|---|---|---|---|---|
| 6,160,901 | A * | 12/2000 | Kage | 382/107 |
| 2002/0051007 | A1* | 5/2002 | Kitagawa et al. | 345/660 |
| 2004/0234163 | A1* | 11/2004 | Lee et al. | 382/298 |
| 2004/0263442 | A1* | 12/2004 | Shingai et al. | 345/76 |

* cited by examiner

*Primary Examiner* — Stephen Sherman
*Assistant Examiner* — Kenneth Bukowski
(74) *Attorney, Agent, or Firm* — Sughrue Mion, PLLC

(57) ABSTRACT

An apparatus and a method are provided for reducing color error in a display having a sub-pixel structure. The method includes: setting at least two directions based on a sub-pixel to be displayed and calculating differences of brightness values of at least two pixels or sub-pixels positioned in the set directions; selecting one of at least two of the differences and determining a direction indicated by the selected difference; determining at least one sub-pixel or pixel neighboring the sub-pixel to be displayed in consideration of the determined direction; and filtering a brightness value of the sub-pixel to be displayed and a brightness value of the determined at least one sub-pixel or pixel and re-assigning the filtered brightness value to the sub-pixel to be displayed.

15 Claims, 6 Drawing Sheets

( a )

( b )

APPARATUS AND METHOD FOR REDUCING COLOR ERROR IN DISPLAY HAVING SUB-PIXEL STRUCTURE

CROSS-REFERENCE TO RELATED APPLICATIONS

This application claims the benefit of priority from Korean Patent Application No. 2004-106749, filed Dec. 16, 2004, in the Korean Intellectual Property Office, the disclosure of which is incorporated herein by reference.

BACKGROUND OF THE INVENTION

1. Field of the Invention

Apparatuses, systems and methods consistent with the present invention relate to representing a color image on a display having a stripe arrangement structure, and more particularly, to reducing color error caused by the use of a pixel rendering method on a display having a stripe arrangement structure to represent an optimum color image.

2. Description of the Related Art

As shown in FIG. 1, a general image display device requires three sub-pixels, i.e., R, G, and B sub-pixels, to represent a pixel. Thus, the general display device separately manipulates the three sub-pixels to theoretically increase a horizontal resolution of a stripe structure shown in FIG. 1 three times. Also, when a high resolution image is displayed in a low resolution display device, a general pixel rendering method generates jagged patterns at the boundaries of minute letters such as italics. The jagged patterns may be reduced by sub-pixel rendering, i.e., separately manipulating sub-pixels. However, the sub-pixel rendering generates a false color rendering at a curved or oblique boundary of an image. A vertical color error may occur at a vertical edge of an image on a display having a sub-pixel structure. These two types of color errors are generated by a sharp change of a brightness value between neighboring sub-pixels. In the case where sub-pixels are arranged in a stripe structure, the two types of color errors may frequently occur in a diagonal or vertical representation.

A conventional method of representing a high resolution input signal on a low resolution display will now be described with reference to FIG. 2.

Referring to FIG. 2, an input signal includes a plurality of pixels each including three sub-pixels as described with reference to FIG. 1. As described with reference to FIG. 1, the three sub-pixels are sub-pixels "R," "G," and "B." As an example, six pixels are shown in FIG. 2. The six pixels are pixels "0" through "5." Thus, the first pixel includes sub-pixels "R0," "G0," and "B0", and the second pixel includes sub-pixels "R1," "G1," and "B1." The fifth pixel includes sub-pixels "R4," "G4," and "B4," and the sixth pixel includes sub-pixels "R5," "G5," and "B5."

A resolution of a display is ⅓ of the resolution of the input signal. Thus, the resolution of the input signal is reduced to ⅓ to represent the input signal on the display. To reduce the resolution of the input signal to ⅓, one of sub-pixels of the pixels of the input signal is selected, and a pixel is represented by the selected sub-pixel. For example, referring to FIG. 2, the sub-pixel "R0" is selected from the first pixel of the input signal to represent the sub-pixel "R0" as the first pixel on the display, and the sub-pixel "G0" is selected from the first pixel to represent the sub-pixel "G0" as the second pixel on the display. Also, the sub-pixel "B0" is selected from the first pixel of the input signal to represent the sub-pixel "B0" as the third pixel on the display, and a sub-pixel "R3" is selected from the fourth pixel of the input signal to represent the sub-pixel "R3" as the fourth pixel on the display. A sub-pixel "G3" is selected from the fourth pixel of the input signal to represent the sub-pixel "G3" as the fifth pixel on the display, and a sub-pixel "B3" is selected from the fourth pixel of the input signal to represent the sub-pixel "B3" as the sixth pixel on the display.

FIG. 3 illustrates another method of representing a high resolution input signal on a low resolution display. Referring to FIG. 3, a sub-pixel "R0" is selected from a first pixel of an input signal to represent the sub-pixel "R0" as the first pixel on a display, and a sub-pixel "G1" is selected from a second pixel of the input signal to represent the sub-pixel "G1" as the second pixel on the display. Also, a sub-pixel "B2" is selected from a third pixel of the input signal to represent the sub-pixel "B2" as the third pixel on the display, and a sub-pixel "R3" is selected from a fourth pixel of the input signal to represent the sub-pixel "R3" as the fourth pixel on the display. A sub-pixel "G4" is selected from a fifth pixel of the input signal to represent the sub-pixel "G4" as the fifth pixel on the display, and a sub-pixel "B5" is selected from a sixth pixel of the input signal to represent the sub-pixel "B5" as the sixth pixel on the display.

While the methods described with reference to FIGS. 2 and 3 are effective for improving resolution, they increase the color error caused by sub-pixel rendering.

FIG. 4 illustrates color error caused by conventional rendering. As described above, sub-pixels are arranged in stripe structures and in the order of R, G, and B. A color error, which occurs between pixels according to the prior art, occurs between sub-pixels due to an increase in size of the pixel on a display having a stripe structure. Referring to FIG. 4, according to pixel unit rendering, brightness is increased by "B" on the left side of "T," and brightness is sharply increased by "R" on the right side of "T." Thus, a color error occurs. The boundary becomes unclear due to the color error.

Accordingly, a method of reducing a color error occurring between sub-pixels using pixel rendering is required.

SUMMARY OF THE INVENTION

The present invention provides an apparatus and a method for reducing color error occurring between sub-pixels due to pixel rendering using sub-pixel rendering.

The present invention also provides an apparatus and a method for reducing color error occurring between sub-pixels in order to represent a clear boundary.

According to an aspect of the present invention, there is provided a method of displaying image data comprising a plurality of pixels each comprising at least two sub-pixels, including: setting at least two directions based on a sub-pixel to be displayed and calculating differences of brightness values of at least two pixels or sub-pixels positioned in the set directions; selecting one of at least two of the differences and determining a direction indicated by the selected difference; determining at least one sub-pixel or pixel neighboring the sub-pixel to be displayed in consideration of the determined direction; and filtering a brightness value of the sub-pixel to be displayed and a brightness value of the determined at least one sub-pixel or pixel and re-assigning the filtered brightness value to the sub-pixel to be displayed.

According to another aspect of the present invention, there is provided a display for displaying image data comprising a plurality of pixels each comprising at least two sub-pixels, including: a measurer measuring differences of brightness values of at least two pixels or sub-pixels positioned in each of set directions according to a control command; a selector comparing the differences of the brightness values transmitted from the measurer and selecting one of the differences; a controller determining a sub-pixel to be displayed and at least one pixel or sub-pixel neighboring the sub-pixel to be displayed in consideration of a direction indicated by the selected difference; and a filter filtering a brightness value of the sub-pixel to be displayed and brightness values of the determined sub-pixels according to the control command output from the controller.

According to still another aspect of the present invention, there is provided a method of display image data comprising a plurality of pixels each comprising at least two sub-pixels, including: setting at least two directions based on a sub-pixel to be displayed and calculating differences of brightness values of at least two pixels or sub-pixels positioned in the set directions; selecting one of at least two of the differences and determining a direction indicated by the selected difference; determining a filter for filtering at least one sub-pixel or pixel neighboring the sub-pixel to be displayed in consideration of the determined direction; and filtering a brightness value of the sub-pixel to be displayed and a brightness value of the determined at least one sub-pixel or pixel and re-assigning the filtered brightness value to the sub-pixel to be displayed.

BRIEF DESCRIPTION OF THE DRAWINGS

The above and other aspects of the present invention will become more apparent by describing certain exemplary embodiments of the present invention with reference to the accompanying drawings, in which.

DETAILED DESCRIPTION OF EXEMPLARY EMBODIMENTS OF THE INVENTION

Figure 1:
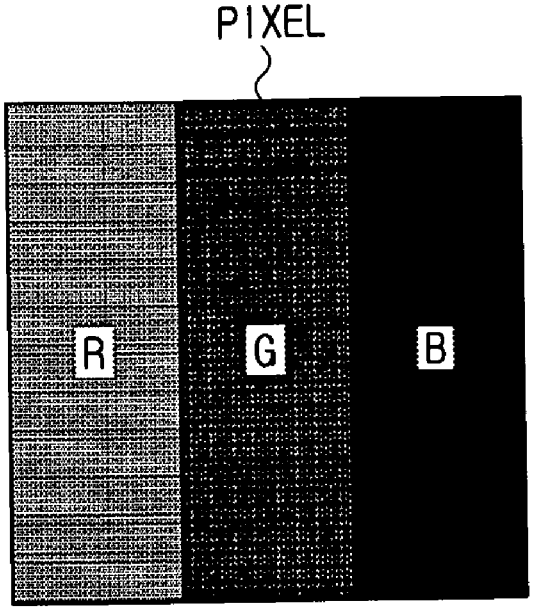
FIG. 1 (PRIOR ART)
FIG. 1 is a view illustrating R, G, and B sub-pixels represented with one pixel displayed on a display having a stripe structure.
Figure 2:
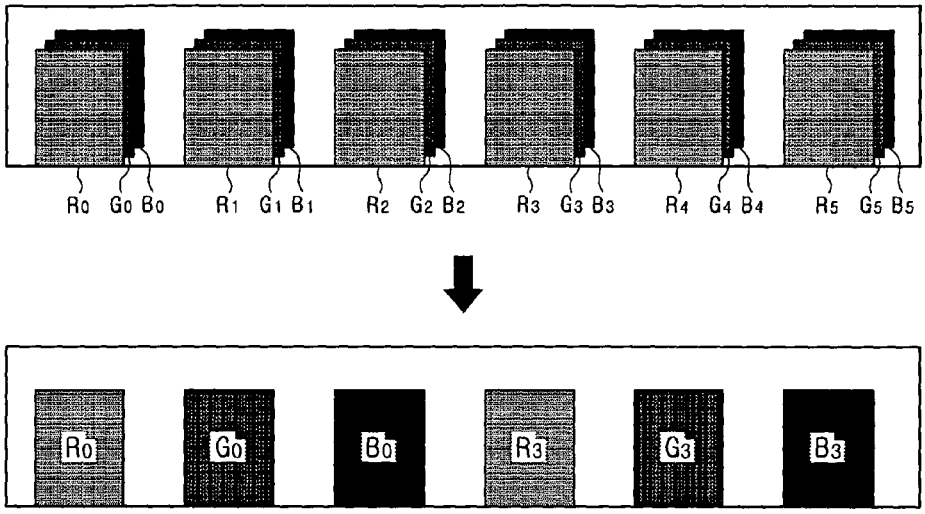
FIG. 2 (PRIOR ART)
FIG. 2 is a view illustrating a conventional method of improving resolution using sub-pixels.
Figure 3:
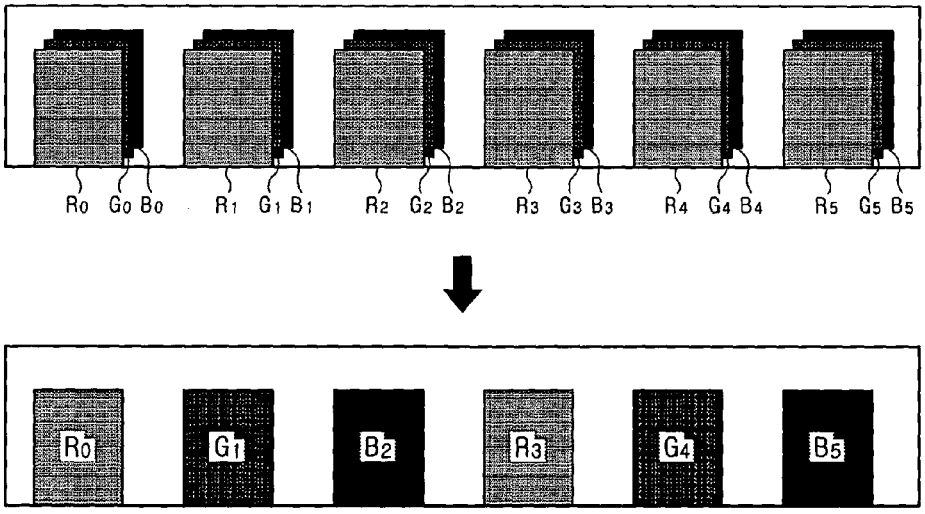
FIG. 3 (PRIOR ART)
FIG. 3 is a view illustrating, another conventional method of improving resolution using sub-pixels.
Figure 4:
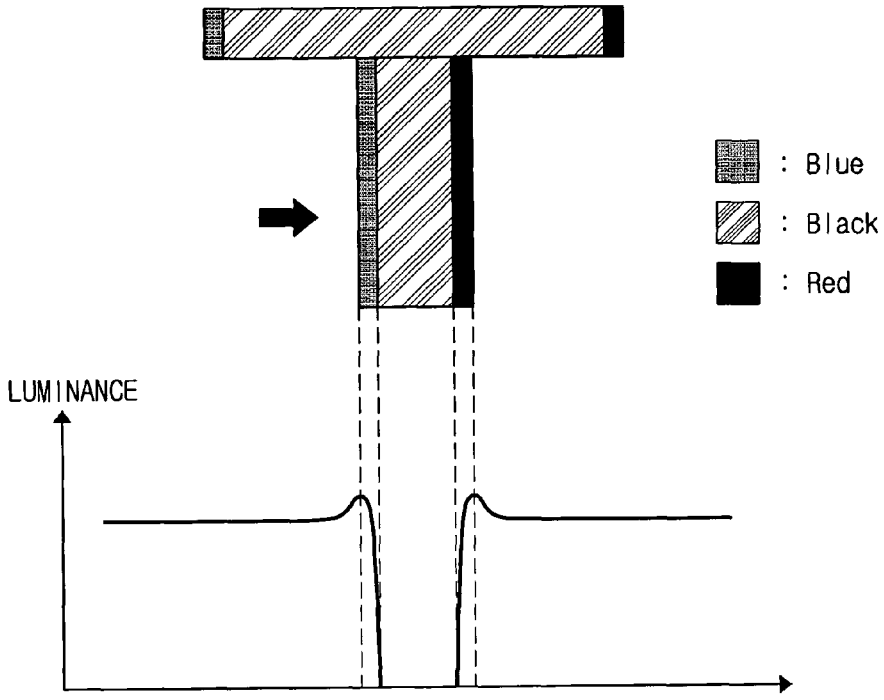
FIG. 4 (PRIOR ART)
FIG. 4 is a view illustrating color error occurring on a display, having a sub-pixel structure, due to pixel rendering.

Certain exemplary embodiments of the present invention will now be described in greater detail with reference to the accompanying drawings. However, the present invention may be embodied in many different forms and should not be construed as being limited to the embodiments set forth herein. Rather, these embodiments are provided so that the disclosure will fully convey the concept of the invention to those skilled in the art. In the following description, same drawing reference numerals are used for the same references in different drawings.

In a case where rendering is performed with respect to sub-pixels constituting a pixel, at least one reference sub-pixel is selected from neighboring pixels, and sub-pixel rendering is performed in consideration of the selected reference sub-pixels.

Figure 5:
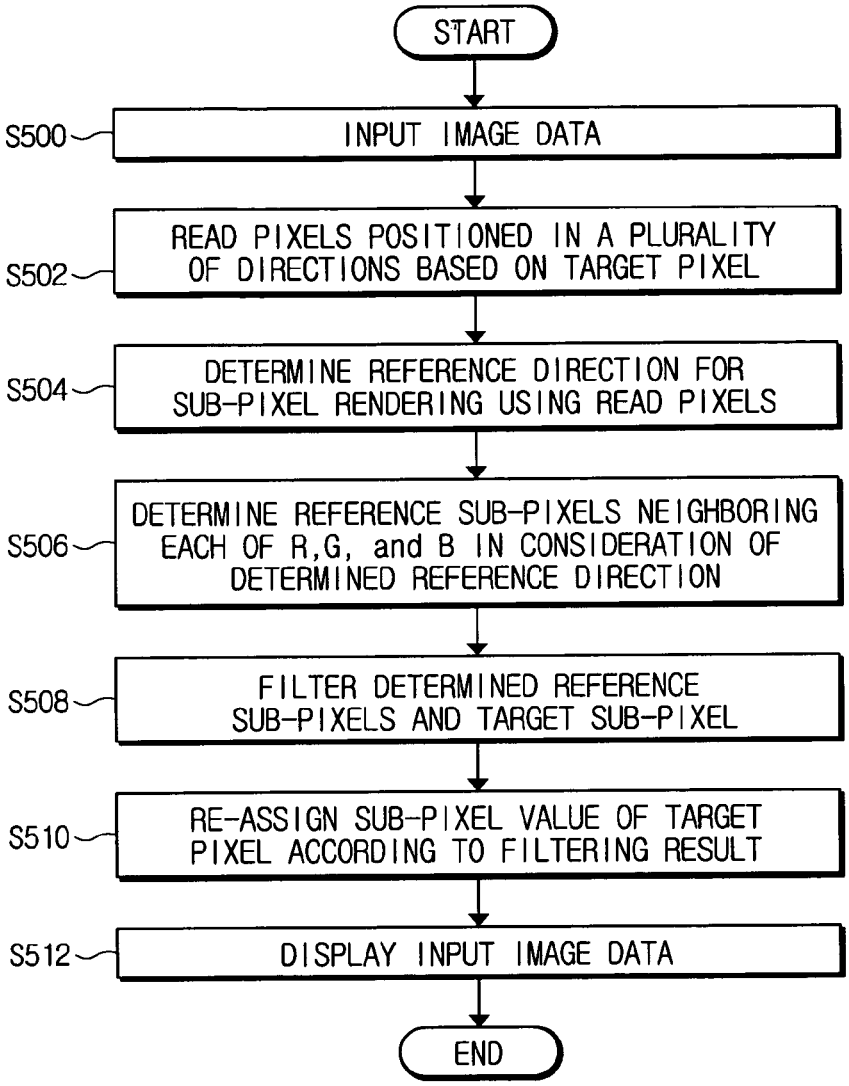
FIG. 5 is a view illustrating a method of reducing color error occurring due to pixel rendering according to an exemplary embodiment of the present invention.

FIG. 5 is a flowchart of a method for reducing color error occurring due to pixel rendering according to an exemplary embodiment of the present invention.

In operation S500, a display receives image data. As described above, the image data input to the display has a stripe structure.

In operation S502, the display reads pixels of the input image data positioned in set directions. The set directions will be described later. In an exemplary embodiment of the present invention, the display sets ten directions and reads pixels positioned in each of the ten directions. However, the number of directions may be variably set, for example, to reduce the operation amount of the display.

In operation S504, the display compares the read pixels to select a reference direction along which sub-pixel rendering is to be performed from the directions in which the read pixels are positioned.

In operation S506, the display determines reference sub-pixels neighboring each of R, G, and B sub-pixels in consideration of the selected reference direction. In operation S508, the display filters the determined neighboring reference sub-pixels and target sub-pixels. The filtering process is not related to the present invention and thus will not be described in detail herein, and may be any filtering process known in the art.

In operation S510, the display re-assigns sub-pixel values to sub-pixels constituting a target pixel using the filtering result. In operation S512, the display represents the input image data using the re-assigned sub-pixel values.

Figure 6:
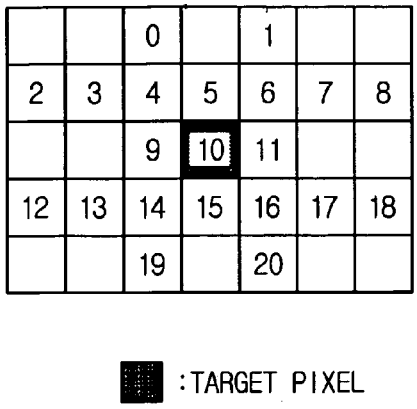
FIG. 6 is a view illustrating a method of determining reference directions according to an exemplary embodiment of the present invention.

The directions described in operation S502 will be described with reference to FIG. 6. FIG. 6 shows input data including 5×7 pixels. For example, a pixel "10" is selected as a target pixel. As described above, the display may consider 10 directions. However, a number of directions may be variably set.

Each of directions will now be described in detail. A first direction refers to a horizontal direction with respect to a target pixel. Thus, the display reads pixels "4," "6," "9," "11," "14," and "16" of pixels positioned in the horizontal direction with respect to the target pixel, the pixels "4," "6," "9," "11," "14," and "16" neighboring the target pixel. A second direction refers to a vertical direction with respect to the target pixel. Thus, the display reads pixels "4" and "14," "5" and "15," "6" and "16" positioned in the vertical direction with respect to the target pixel, the pixels "4" and "14," "5" and "15," "6" and "16" neighboring the target pixel.

The third through tenth directions are diagonal directions. Thus, the display reads pixels positioned in the diagonal directions with respect to the target pixel. In particular, the display reads pixels "7" and "9," "8" and "12," "11" and "13" in the third direction, and pixels "5" and "9," "6" and "14," and "11" and "15" in the fourth direction.

The display reads pixels "6" and "9," "7" and "13," and "11" and "14" in the fifth direction, and pixels "5" and "14," "1" and "19," and "6" and "15" in the sixth direction. The display reads pixels "3" and "11," "2" and "18," and "9" and "17" in the seventh direction, and pixels "9" and "15," "4" and "16," and "5" and "11" in the eighth direction. The display reads pixels "4" and "11," "3" and "17," and "9" and "16" in the ninth direction, and pixels "5" and "16," "0" and "20," and "4" and "15" in the tenth direction.

The display measures gradients of brightness of pixel values read in each of the directions and compare the gradients to select a neighboring reference direction with respect to the target pixel.

A method of selecting a neighboring reference direction will now be described in detail.

The display measures gradients between the pixels "4" and "6," between the pixels "9" and "11," and betweens the pixels "14" and "16" read in the first direction. The display calculates an average of the measured gradients to obtain a gradient of the first direction. The display measures gradients between the pixels "4" and "14," between the pixels "5" and "15," and between the pixels "6" and "16" read in the second direction. The display calculates an average of the measured gradients to obtain a gradient of the second direction. The display performs the above-described process with respect to the third through tenth directions.

The display compares the gradients of the first through tenth directions and determines the direction having the largest or smallest gradient as a neighboring reference direction according to the comparison result.

A process of determining reference sub-pixels neighboring each of R, G, and B sub-pixels in consideration of the determined neighboring reference direction will now be described.

The case where the display determines the third direction as a neighboring reference direction will be taken as an example. If the display determines the third direction as a neighboring reference direction, the display determines reference sub-pixels neighboring sub-pixels constituting a target pixel as follows.

The display determines sub-pixels "R" constituting pixels "5" and "12" as reference sub-pixels neighboring a sub-pixel "R" of sub-pixels of the target pixel (pixel "10"). The display determines sub-pixels "G" of pixels "8" and "12" as reference sub-pixels neighboring a sub-pixel "G" of the sub-pixels of the target pixel. The display determines pixels "8" and "15" as reference sub-pixels neighboring a sub-pixel "B" of the sub-pixels of the target pixel. This will now be described in more detail.

Sub-pixels "G" of sub-pixels of the target pixel "10" are extracted from pixels positioned in a reference direction. In other words, sub-pixels "G" of pixels "8" and "12" positioned in the third direction are determined as reference sub-pixels neighboring the sub-pixels "G" of the target pixel "10." Also, reference sub-pixels neighboring sub-pixels "R" of the target pixel "10" are selected from sub-pixels of neighboring pixels positioned above or on the left side of the target pixel "10." Since sub-pixels are arranged in the order of R, G, and B in the stripe structure, reference sub-pixels neighboring sub-pixels "R" are determined from pixels positioned on a determined reference direction or pixels positioned above the determined reference direction.

Referring to FIG. 6, a sub-pixel "R" of the pixel "5" is closest to the sub-pixel "R" of the target pixel "10." Thus, the display determines the sub-pixel "R" of the pixel "5" as a reference sub-pixel neighboring the sub-pixel "R." Also, a pixel positioned in a direction most similar to the third direction is extracted in consideration of the pixel "5." As described above, the pixel "12" is positioned in the direction most similar to the third direction. In other words, a direction formed by the pixels "5" and "12" is most similar to the third direction. Thus, the display determines sub-pixels "R" of the pixels "5" and "12" as reference sub-pixels neighboring the sub-pixel "R."

A reference sub-pixel neighboring the sub-pixel "B" of the target pixel "10" is selected from neighboring pixels positioned under or on the right side of the target pixel "10." Referring to FIG. 6, a sub-pixel "B" of the pixel "15" is closest to the sub-pixel "B" of the target pixel "10." Thus, the display determines the sub-pixel "B" of the pixel "15" as a reference sub-pixel neighboring the sub-pixel "B." Also, a pixel positioned in a direction most similar to the third direction is extracted in consideration of the pixel "5." As described above, a pixel "8" is positioned in the direction most similar to the third direction. In other words, a direction formed by the pixels "8" and "15" is most similar to the third direction. Thus, the display determines sub-pixels "B" of the pixels "8" and "15" as reference sub-pixels neighboring the sub-pixel "B."

The display re-assigns brightness values (luminance values) of sub-pixels of the target pixel "10" using the determined sub-pixels. In other words, the display re-assigns the corresponding sub-pixels of the target pixel "10" brightness values obtained by filtering the brightness values of the sub-pixels of the target pixel "10" and brightness values of reference sub-pixels neighboring the sub-pixels instead of the brightness values of the sub-pixels of the target pixel "10."

Only the process of comparing the brightness values of sub-pixels of a target pixel with brightness values of sub-pixels of a neighboring pixel has been described. However, the present invention is not limited to only comparing the brightness values of sub-pixels. In other words, brightness values of sub-pixels of a target pixel may be compared with a brightness value of a neighboring pixel, or a brightness value of the target pixel may be compared with the brightness value of the neighboring pixel. Alternatively, the brightness value of the target pixel may be compared with brightness values of sub-pixels of the neighboring pixel. A process of comparing brightness values is as described above and thus will not be described herein. In the case where comparison values of sub-pixels are compared with one another, different colors may be compared.

Figure 7:
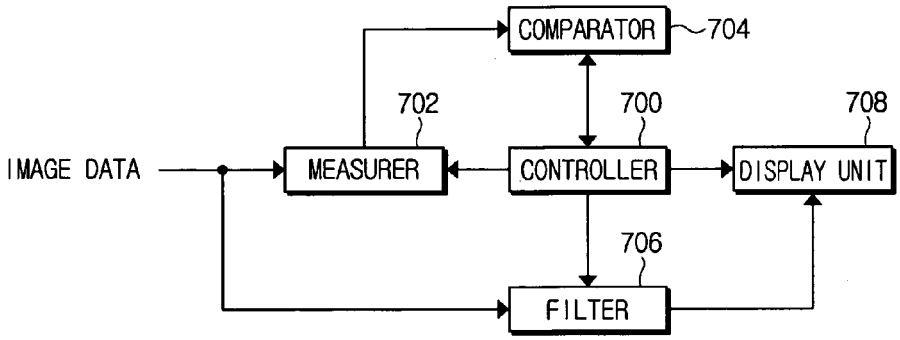
FIG. 7 is a block diagram of a display according to an exemplary embodiment of the present invention.

FIG. 7 is a block diagram of a display according to an embodiment of the present invention. Referring to FIG. 7, the display includes a controller 700, a measurer 702, a comparator 704, a filter 706, and a display unit 708. The display may include other elements besides the above-mentioned elements. However, for convenience, only elements described in more detail below are shown in FIG. 7.

The measurer 702 measures gradients of brightness values of pixels in each of the directions with respect to a target pixel of input image data according to a control command output from the controller 700. The process of measuring the gradients of the brightness values of the pixels in each of the directions via the measurer 702 is as described above. The measurer 702 transmits the measured gradients to the comparator 704 according to a control command from the controller 700.

The comparator 704 compares the gradients, determines a direction having the largest gradient, and transmits information about the determined direction to the controller 700.

The controller 700 transmits a control command to control the elements of the display. The controller 700 also determines reference sub-pixels neighboring sub-pixels of the target pixel using the information about the determined direction, i.e., the information being transmitted from the comparator 704. The controller 700 instructs the filter 706 to filter the input image data in consideration of the determined reference sub-pixels.

The filter 706 filters a brightness value of a target sub-pixel of the input image data and brightness values of reference sub-pixels neighboring the target sub-pixel. The controller 700 re-assigns a brightness value to the target sub-pixel in consideration of the brightness value of the target sub-pixel and the brightness values of the reference sub-pixels filtered by the filter 706.

The controller 700 transmits the re-assigned brightness value to the display unit 708, and the display unit 708 displays the input image data using the brightness value of the target sub-pixel.

Figure 8:
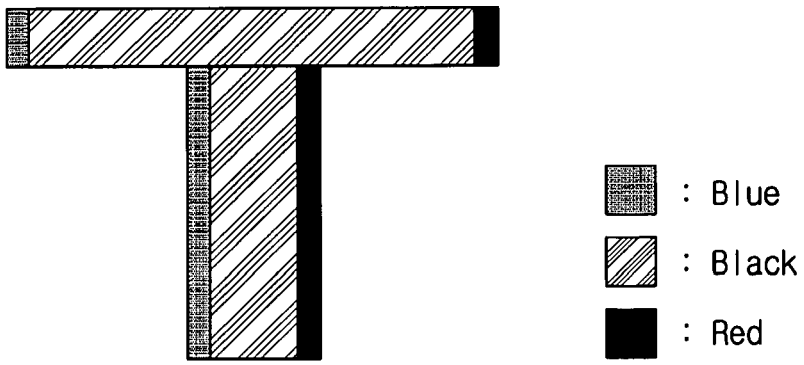
FIG. 8 is a view illustrating a reduced color error according to an exemplary embodiment of the present invention.
Figure 8:
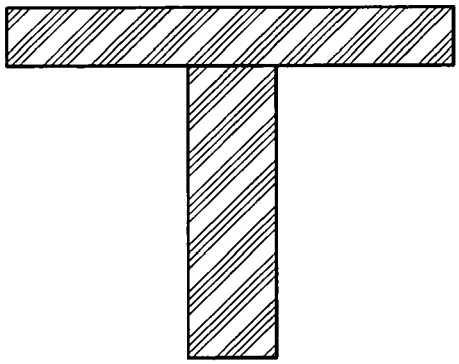

FIG. 8 is a view illustrating the reduction in color error occurring between sub-pixels according to an exemplary embodiment of the present invention. FIG. 8A illustrates color error occurring between sub-pixels according to the prior art, and FIG. 8B illustrates the removal of a color error occurring between sub-pixels in consideration of neighboring reference sub-pixels according to an exemplary embodiment of the present invention.

As described above, a brightness value of a sub-pixel of a target pixel can be re-assigned in consideration of neighboring reference sub-pixels, thereby reducing color error. Also, a color error between sub-pixels can be reduced. As a result, a plasma display panel (PDP) or a liquid crystal display (LCD) having a stripe sub-pixel structure can obtain a clear boundary so as to represent a high-quality image.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A method of displaying image data comprising a plurality of pixels each comprising at least two sub-pixels, the method comprising:

setting at least two directions relative to a target sub-pixel to be displayed;

calculating, for each of the set directions, differences of brightness values of at least two pixels or sub-pixels positioned in the each of the set directions in current input image data, one of the at least two pixels or sub-pixels positioned on one side of the target sub-pixel and another of the at least two pixels or sub-pixels positioned on the other side of the target sub-pixel;

selecting one of the differences and determining a reference direction indicated by the selected difference;

selecting in the reference direction at least one sub-pixel or pixel neighboring the target sub-pixel to be displayed; and filtering a brightness value of the target sub-pixel to be displayed and a brightness value of the at least one sub-pixel or pixel which is selected and re-assigning the filtered brightness value to the sub-pixel to be displayed.

2. The method of claim 1, wherein the sub-pixels constitute the plurality of pixels sequentially on a space that is a stripe structure.

3. The method of claim 1, wherein the calculating the differences of brightness values comprises differences between brightness values of pixels or sub-pixels positioned in an opposite direction to the reference direction.

4. The method of claim 3, wherein a number of the set directions is 10.

5. The method of claim 1, wherein the at least one sub-pixel is selected from sub-pixels positioned in the reference direction and sub-pixels neighboring the reference direction.

6. The method of claim 5, wherein if the sub-pixels form a stripe structure in an order of R, G, and B, a sub-pixel determined with respect to a sub-pixel "R" is positioned on a left side compared to a sub-pixel determined with respect to a sub-pixel "B."

7. The method of claim 1, wherein the reference direction is selected according to one of the largest and smallest differences of the differences between the at least two brightness values.

8. A display for displaying image data comprising a plurality of pixels each comprising at least two sub-pixels, the display comprising:

a measurer which measures, for each of a plurality of directions, differences of brightness values of at least two pixels or sub-pixels positioned in the each of the directions in current input image data, one of the at least two pixels or sub-pixels positioned on one side of a target sub-pixel and another of the at least two pixels or sub-pixels positioned on the other side of the target sub-pixel in the direction according to a control command;

a selector which compares the differences of the brightness values from the measurer and selects one of the differences as a reference direction;

a controller which selects a sub-pixel to be displayed and at least one pixel or sub-pixel neighboring the sub-pixel to be displayed in the reference direction; and a filter filtering which filters a brightness value of the sub-pixel to be displayed and brightness values of the selected at least one pixel or sub-pixel according to the control command output from the controller.

9. The display of claim 8, wherein the controller re-assigns the filtered brightness value to the sub-pixel to be displayed and instructs a display unit to display the sub-pixel having the re-assigned brightness value.

10. The display of claim 8, wherein the sub-pixels constitute the plurality of pixels sequentially on a space such as a stripe structure.

11. The display of claim 8, wherein the at least one sub-pixel is selected from sub-pixels positioned in the reference direction and sub-pixels neighboring the reference direction.

12. The display of claim 8, wherein the reference direction is selected according to one of the largest and smallest differences of the differences between the at least two brightness values.

13. A method of display image data comprising a plurality of pixels each comprising at least two sub-pixels, the method comprising:

setting at least two directions relative to a target sub-pixel to be displayed;

calculating differences of brightness values of at least two pixels or sub-pixels positioned in the each of the set direction in current input image data, one of the at least two pixels or sub-pixels positioned on one side of the target sub-pixel and another of the at least two pixels or sub-pixels positioned on the other side of the target sub-pixel in each of the set directions;

selecting one of the differences and determining a reference direction indicated by the selected difference;

determining a filter for filtering at least one sub-pixel or pixel neighboring the target sub-pixel to be displayed in the reference direction; and filtering a brightness value of the target sub-pixel to be displayed and a brightness value of the at least one sub-pixel or pixel which is selected and re-assigning the filtered brightness value to the target sub-pixel to be displayed.

14. The method of claim 1, wherein:

calculating differences of the brightness values comprises calculating, for each of the set directions, the difference of brightness values between a first pixel or sub-pixel on the one side of the target sub-pixel and a second pixel or sub-pixel on the another side of the target sub-pixel, and between a third pixel or sub-pixel on the one side of the target sub-pixel and a fourth pixel or sub-pixel on the another side of the target sub-pixel; and the method further comprises:

calculating, for each of the set directions, a gradient of the set direction comprising an average of the difference between the first pixel or sub-pixel and the second pixel or sub-pixel, and the difference between the third pixel or sub-pixel and the fourth pixel or sub-pixel; and wherein determining the reference direction comprises comparing the gradients of the set directions and determining a largest or smallest gradient as the reference direction.

15. The method of claim 1, wherein the at least two pixels or sub-pixels are of a same color as the target sub-pixel.

* * * * *